US007032966B2

(12) United States Patent
Myers

(10) Patent No.: US 7,032,966 B2
(45) Date of Patent: Apr. 25, 2006

(54) SWIVEL HIGH CHAIR

(75) Inventor: Peter Jonathan Myers, Wheaton, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 10/894,383

(22) Filed: Jul. 19, 2004

(65) Prior Publication Data

US 2004/0256896 A1 Dec. 23, 2004

Related U.S. Application Data

(62) Division of application No. 10/193,808, filed on Jul. 12, 2002, now abandoned.

(60) Provisional application No. 60/304,952, filed on Jul. 12, 2001.

(51) Int. Cl.
*A47C 1/06* (2006.01)

(52) U.S. Cl. ..... 297/137; 297/148; 297/174 R; 297/256.13; 297/130; 297/344.21

(58) Field of Classification Search ..... 297/137, 297/148, 153, 174 R, 344.21, 325, 329, 118, 297/129, 130, 256.13, 423.43, 423.44, 423.46; 248/346.07, 424; 108/138, 142, 143
See application file for complete search history.

(56) References Cited

U.S. PATENT DOCUMENTS

| | | | | |
|---|---|---|---|---|
| 100,905 | A | | 3/1870 | Knell |
| 161,905 | A | * | 4/1875 | Schoeninger ..... 297/154 |
| 392,174 | A | | 10/1888 | Koken |
| 598,877 | A | | 2/1898 | Rollert |
| 947,015 | A | | 1/1910 | Fiore |
| 1,313,330 | A | * | 8/1919 | Pocock ..... 297/137 |
| 1,669,757 | A | | 5/1928 | Irvine |
| 1,746,986 | A | | 2/1930 | Bell |
| 2,454,599 | A | * | 11/1948 | Dunson ..... 297/137 |
| D153,672 | S | * | 5/1949 | Di Giorgio ..... D6/339 |
| 2,481,725 | A | | 9/1949 | Culley et al. |
| 2,842,374 | A | | 7/1958 | Benson et al. |
| 2,845,990 | A | | 8/1958 | Hubert |
| 2,916,084 | A | | 12/1959 | Bottermiller et al. |
| 3,185,305 | A | * | 5/1965 | Silverman ..... 248/419 |
| 3,642,320 | A | | 2/1972 | Ward |
| 3,649,074 | A | | 3/1972 | McDonald et al. |
| 3,975,050 | A | | 8/1976 | McKee |
| 4,046,419 | A | | 9/1977 | Schmitt |
| 4,065,175 | A | | 12/1977 | Perego |
| 4,082,349 | A | * | 4/1978 | Ballenger ..... 297/183.6 |
| 4,518,139 | A | | 5/1985 | Barfell |
| 4,570,997 | A | | 2/1986 | Tanizaki et al. |
| 4,722,570 | A | | 2/1988 | Bertoli |
| 4,762,364 | A | | 8/1988 | Young |
| 4,936,629 | A | | 6/1990 | Young |

(Continued)

FOREIGN PATENT DOCUMENTS

FR 2680734 A1 * 3/1995

*Primary Examiner*—Peter R. Brown
*Assistant Examiner*—Joe Edell
(74) *Attorney, Agent, or Firm*—Hanley, Flight & Zimmerman, LLC

(57) ABSTRACT

A high chair for feeding a child is disclosed. The high chair includes a base and a chair sized to support a child. The chair is supported on the base at a height suitable for feeding a child. The chair is rotatable relative to the base about a substantially vertical axis.

23 Claims, 9 Drawing Sheets

U.S. PATENT DOCUMENTS 4,957,302 A 9/1990 Maxwell
4,958,885 A 9/1990 Kassai
5,211,607 A * 5/1993 Fermaglish et al. ..... 472/15
5,451,093 A 9/1995 Petrie et al.
5,480,210 A 1/1996 Lehenbauer et al.
5,482,354 A 1/1996 Gryp
5,489,140 A 2/1996 Van Horn-Plato
5,524,968 A 6/1996 Stoltz
5,527,096 A 6/1996 Shimer
6,033,019 A 3/2000 Hession-Kunz et al.
6,089,654 A * 7/2000 Burstein ..... 297/151
6,089,666 A * 7/2000 Rosko ..... 297/344.1
6,176,459 B1 * 1/2001 Wilcox et al. ..... 248/371
6,327,982 B1 * 12/2001 Jackson ..... 108/5

* cited by examiner

SWIVEL HIGH CHAIR

RELATED APPLICATION

This patent arises from a patent application which is a divisional of U.S. patent application Ser. No. 10/193,808, which was filed on Jul. 12, 2002 now abandoned and which claims the benefit of U.S. Provisional Application Ser. No. 60/304,952, filed on Jul. 12, 2001. U.S. patent application Ser. No. 10/193,808 is hereby incorporated by reference in its entirety.

FIELD OF THE DISCLOSURE

This disclosure is generally related to high chairs for children, and more particularly to a high chair that has a seat that can swivel.

BACKGROUND

High chairs are known which include a seat for supporting a child. The seat is typically elevated above a floor to a level that is convenient for an adult to feed the child from the adult's sitting position. Prior art high chairs have a fixed seat that is oriented in a forward-facing direction of the high chair. When the high chair is situated on a floor surface, the seat position is forward facing at all times. It is sometimes desirable to re-orient the direction in which the child and high chair seat face. To re-orient the seat so that it faces in a different direction, the entire high chair must be rotated relative to the floor surface.

Prior art high chairs include trays that can be affixed and removed from the front of the seat. The trays provide a serving surface for providing the child with food, drinks and other items such as eating utensils and/or toys. Some prior art trays can be slid toward and away from the seat along a straight line.

DETAILED DESCRIPTION

Figure 1:
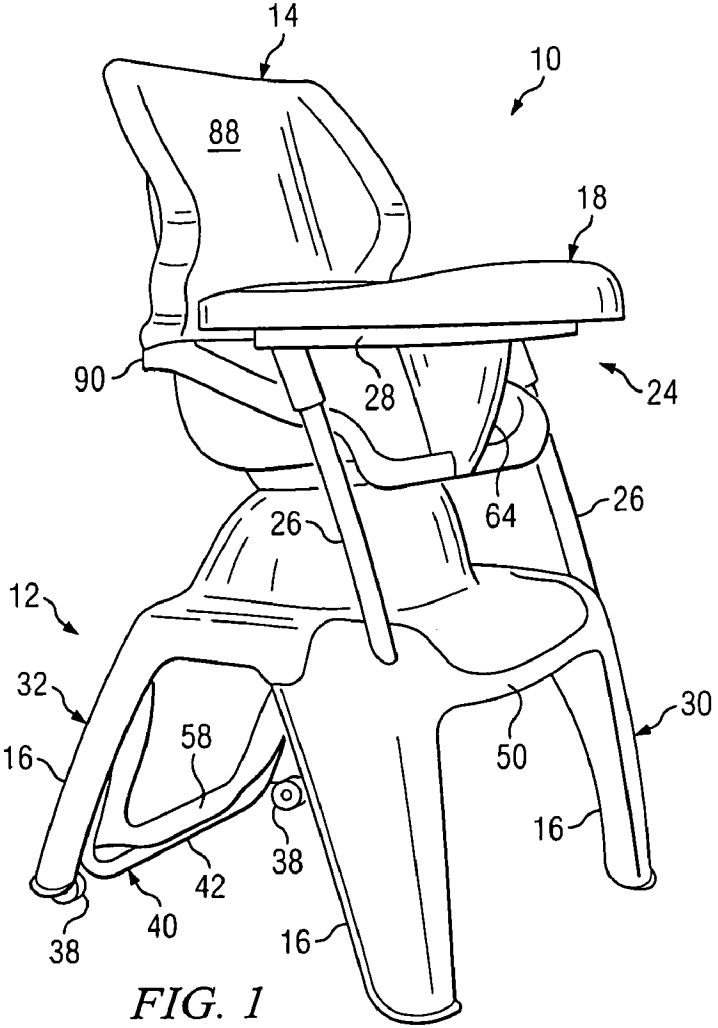
FIG. 1 is a perspective view of an example high chair constructed in accordance with the teachings of the present invention and shown with the seat in a forward-facing orientation.
Figure 7:
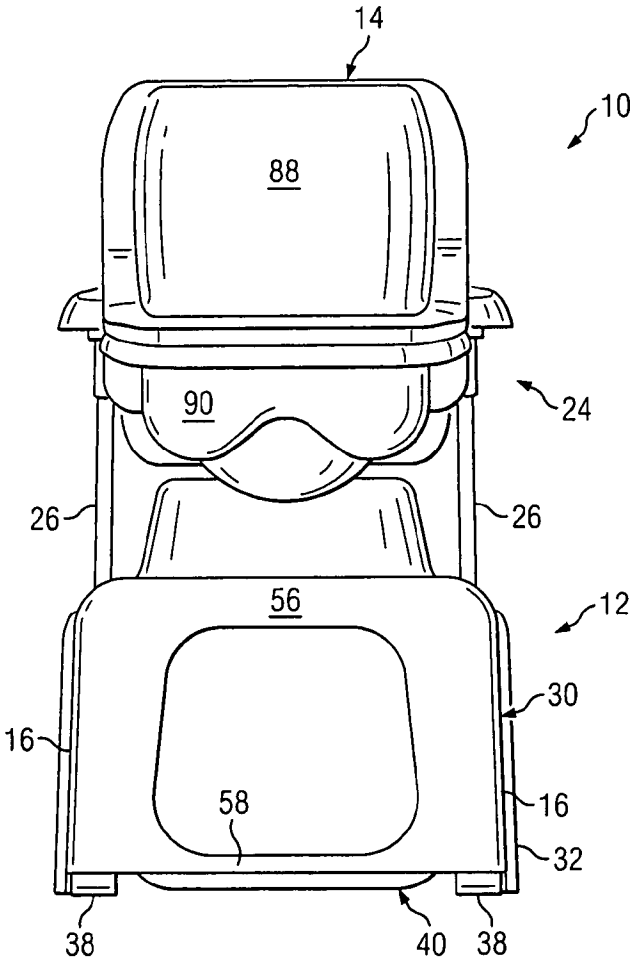
FIG. 7 is a rear view of the high chair of FIG. 1.

An example high chair 10 constructed in accordance with the teachings of the invention is shown in FIG. 1. The illustrated high chair 10 includes a base 12 and a seat 14. The base 12 includes a number of legs 16. The legs 16 of the base 12 are dimensioned to engage a ground surface to support the seat 14 at a height above the ground surface such that an adult seated in a conventional chair can easily feed a child seated in the chair 14.

The chair 14 is sized to support a seated child. The child can be of any suitable age and ability, but is typically incapable of comfortably eating from a conventional table when seated in a conventional chair.

Significantly, the seat 14 is rotatable relative to the base 12 about a substantially vertical axis. Preferably, the seat 14 can rotate in either a generally counterclockwise or generally clockwise direction through 360° while remaining fixedly secured to the base 12. A seat 14 can also be provided where the seat can pivot through angles less than 360° if desired.

As shown in FIGS. 1, 2, 3 and 5, the high chair 10 preferably includes a serving tray 18 to support food, drinks and other objects (e.g., eating utensils, toys) at a height and position accessible to a child seated in the chair 14. The serving tray 18 can be of any desired shape, size and material. Preferably, the tray 18 is constructed of a washable, non-porous, and stain resistant material such as plastic. The tray 18 preferably includes a raised perimeter or recessed central area 20 (see FIG. 5) to provide a reservoir for catching spilled liquids and the like.

Preferably, the tray 18 is mounted independent of the seat 14 such that the seat 14 can be rotated independent of the tray 18 to facilitate placing a child in the chair 14 or removing the child from the chair 14 without requiring movement or removal of the tray 18. Oftentimes, the most difficult time of feeding is when a child is impatiently waiting in a prior art high chair for the food to arrive on the tray or impatiently waiting to get out of the prior art high chair during post meal clean up. Pivoting the seat 14 independent of the tray 14 as shown herein permits an impatient child to be placed in the seat 14 after the food is present on the tray 18 and/or to be removed from the seat 14 before the clean up activities are completed.

In the example of FIGS. 1–8, the tray 18 is removably attached to a tray support 24. As most easily seen in FIGS. 1 and 6, the illustrated tray support 24 includes a pair of legs 26 and a support surface 28. One end of each of the legs 26 is mounted on the base 12. The opposite ends of the legs are coupled to the support surface 28. In the example of FIGS. 1–8, the tray support 24 is fixedly mounted to the base 12. On the other hand, the tray 18 is removably mounted to the tray support 24 via a conventional releasable connection such as tabs and slots, friction fit, portable catch arms, etc. Thus, the illustrated tray support 24 is not removable from the base 12, but the tray 18 can be removed from the tray support 24 for cleaning and the like.

Figure 4:
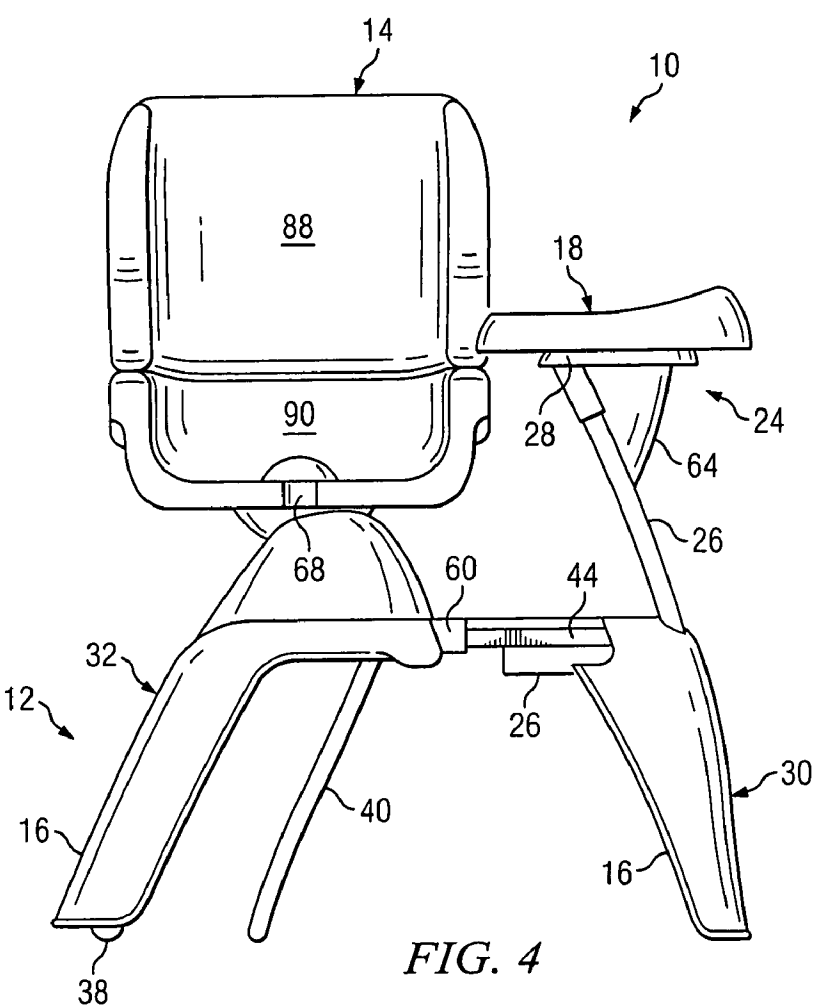
FIG. 4 is a view similar to FIG. 3, but showing the base in the extended position and the chair pivoted to a side facing position.

As most easily seen in FIG. 4, in the example of FIGS. 1–8 the base 12 includes a first section 30 supporting the tray support 24 and the tray 18, and a second section 32 supporting the seat or chair 14. As also shown in FIG. 4, the first and second sections can be slidably displaced between a closed position (for example, the position of FIG. 3) and an extended position (for example, the position of FIG. 4). To facilitate this displacement, the second section 32 of the base 14 is mounted on rollers 38, while the first section 30 of the base 14 frictionally engages the ground surface. Thus, the second section 32 of the base 14 can be rolled away from the first base section 30 via the rollers 38 to separate the seat 14 and the tray 18.

To provide the base 12 with structural integrity, the base 12 includes a frame 40. The frame 40 is preferably formed of metal tubes joined together or integrally formed to provide a U-shaped base member 42 (see FIG. 2) that engages the ground surface and a horizontally extended rail portion 44. The rail portion 44 is fixedly connected to the legs 26 of the tray support 24 via conventional fasteners such as bolts, screws or rivets. To this end, the legs 26 preferably bend backward after extending downwardly and forwardly from the support surface 28 as shown in FIG. 4.

Figure 2:
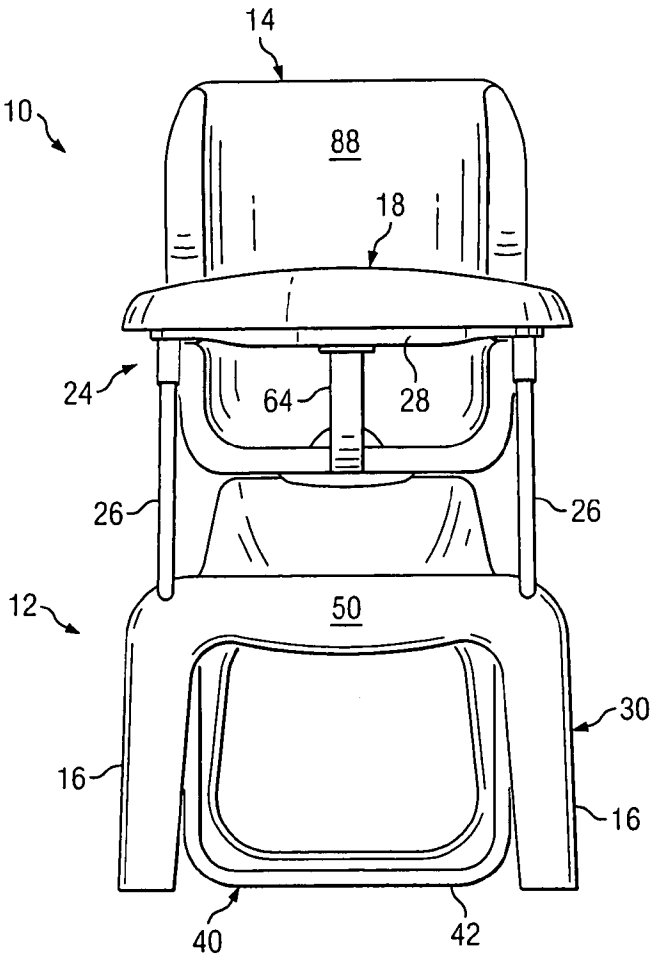
FIG. 2 is a front view of the high chair of FIG. 1.
Figure 3:
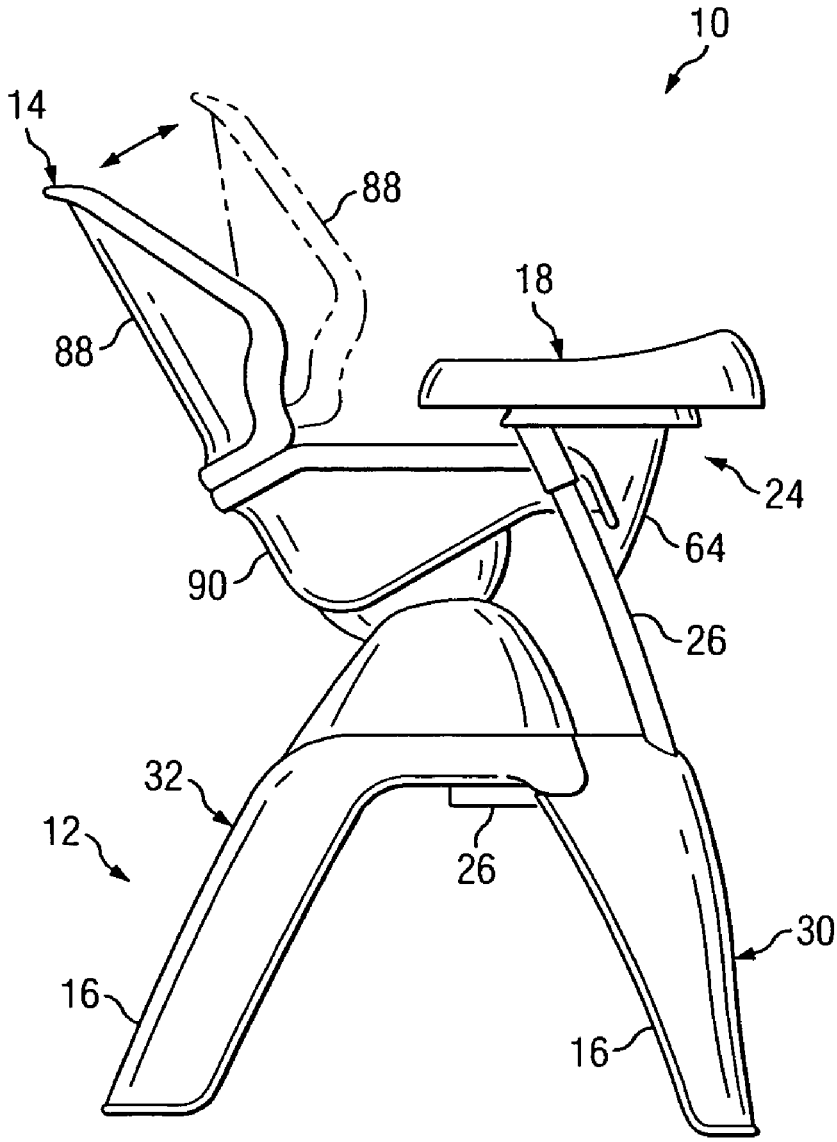
FIG. 3 is a side view of the high chair of FIG. 1.
Figure 6:
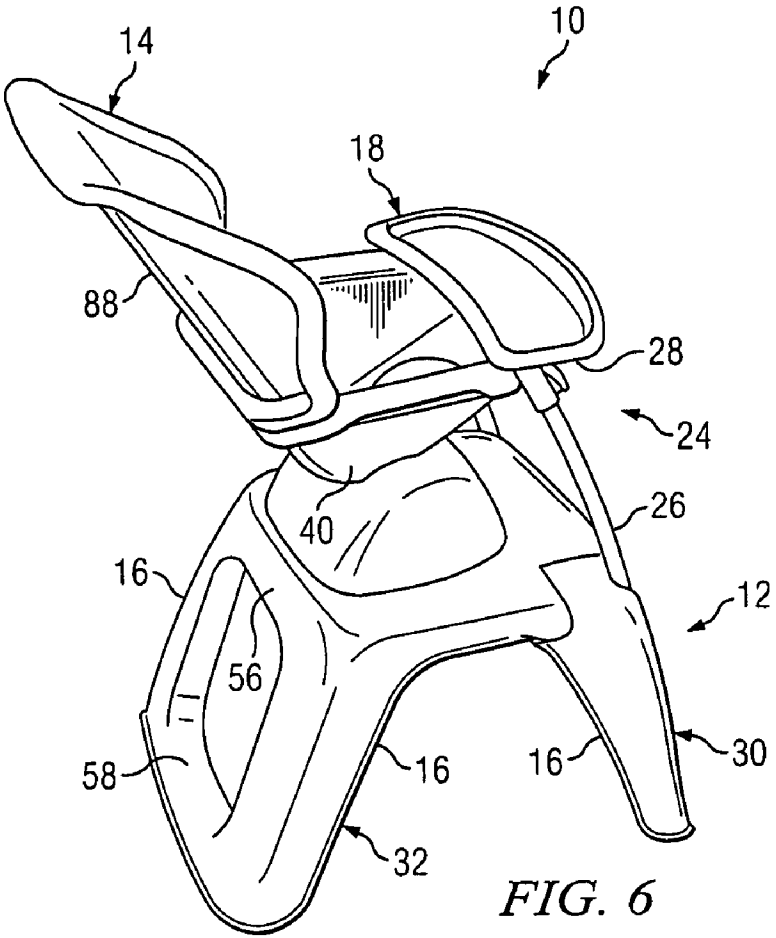
FIG. 6 is a rear perspective view of the high chair of FIG. 1.
Figure 5:
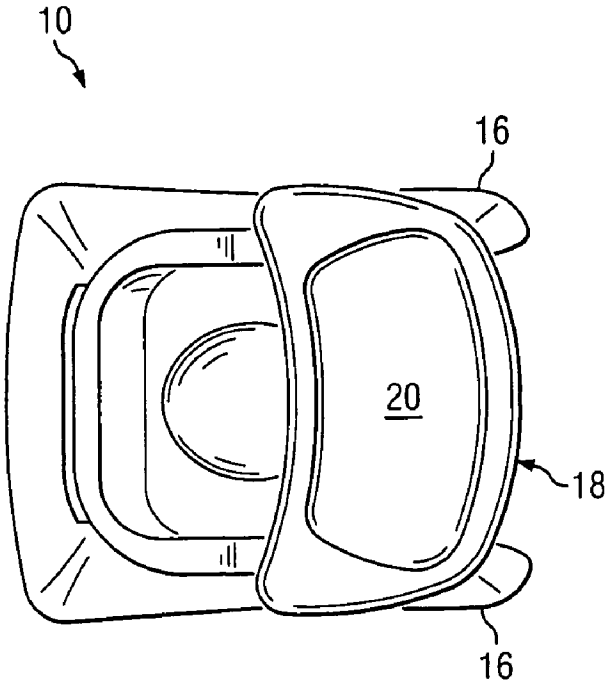
FIG. 5 is a top view of the high chair of FIG. 1.

To support the rail portion 44 of the frame 40 in a generally horizontal position, the first section 30 of the base 12 includes downwardly extending legs 16 joined by a cross-member 50 (see FIG. 2). The legs 16 and cross-member 50 are preferably integrally formed of molded plastic. Preferably, each of the legs 26 of the tray support 24 extend through a respective hole defined in the first base section 30 where they rest upon ledges formed interior to the first base section 30. The legs 26 are preferably secured to the ledges of the first base section by conventional fasteners such as screws, bolts or rivets.

To provide for relative movement between the first and second base sections 30, 32, the second base section 32 is slidably mounted to the horizontal rails 44 of the frame 40. Like the first base portion 30, the second base portion 32 comprises two legs 16 joined by an upper cross-member 56 (see FIG. 7). However, the second base member 32 also includes a lower cross-member 58 joining the legs 16 for enhanced structural rigidity. The legs 16 and the cross-members 56, 58 of the second base member 32 are preferably integrally formed of molded plastic.

As shown in FIG. 4, the forward end of the second base member 32 defines two semi-cylindrical yokes 60. Each of the yokes 60 slidably receives one of the horizontal rails 44 to slidably secure the second base member 32 to the frame 40.

To restrain a seated child in the high chair, the tray support 24 preferably includes a divider 64 (see FIGS. 2 and 4). As most easily seen in FIG. 2, the divider 64 extends downwardly in a generally vertical orientation from the support 24. As shown in FIG. 4, the seating surface of the seat 14 preferably defines a notch 68 that receives the divider 64 when the first and second base portions 30, 32 are slid to their closed position and the seat 14 is forwardly oriented. This cooperation between the notch 68 and the divider 64 permits reclining of the seat (see FIG. 3) as explained below, while ensuring a seated child cannot slide out of the seat 14 under the tray 18. To this end, one leg of the seated child is preferably positioned on each side of the divider 44.

Although for simplicity of illustration it is not shown in the drawings, the high chair 10 preferably also includes a conventional safety restraint in the form of a three-point seat belt for securing the child in the seat 14.

Because of the presence of the divider 44 and the tray support legs 26, persons of ordinary skill in the art will appreciate that the seat 14 cannot be rotated when the first and second base portions 30, 32 are in the closed position (see FIG. 3) and a child is seated in the chair 14. Instead, the seat 14 can only be rotated relative to the base 12 and tray 18 when the second base section 32 is displaced a distance from the first base section 30 and/or vice versa. The cooperation of the notch 68 and divider 64 provides a lock out against rotation of the seat 14 even when no child is seated in the chair 14.

Figure 8:
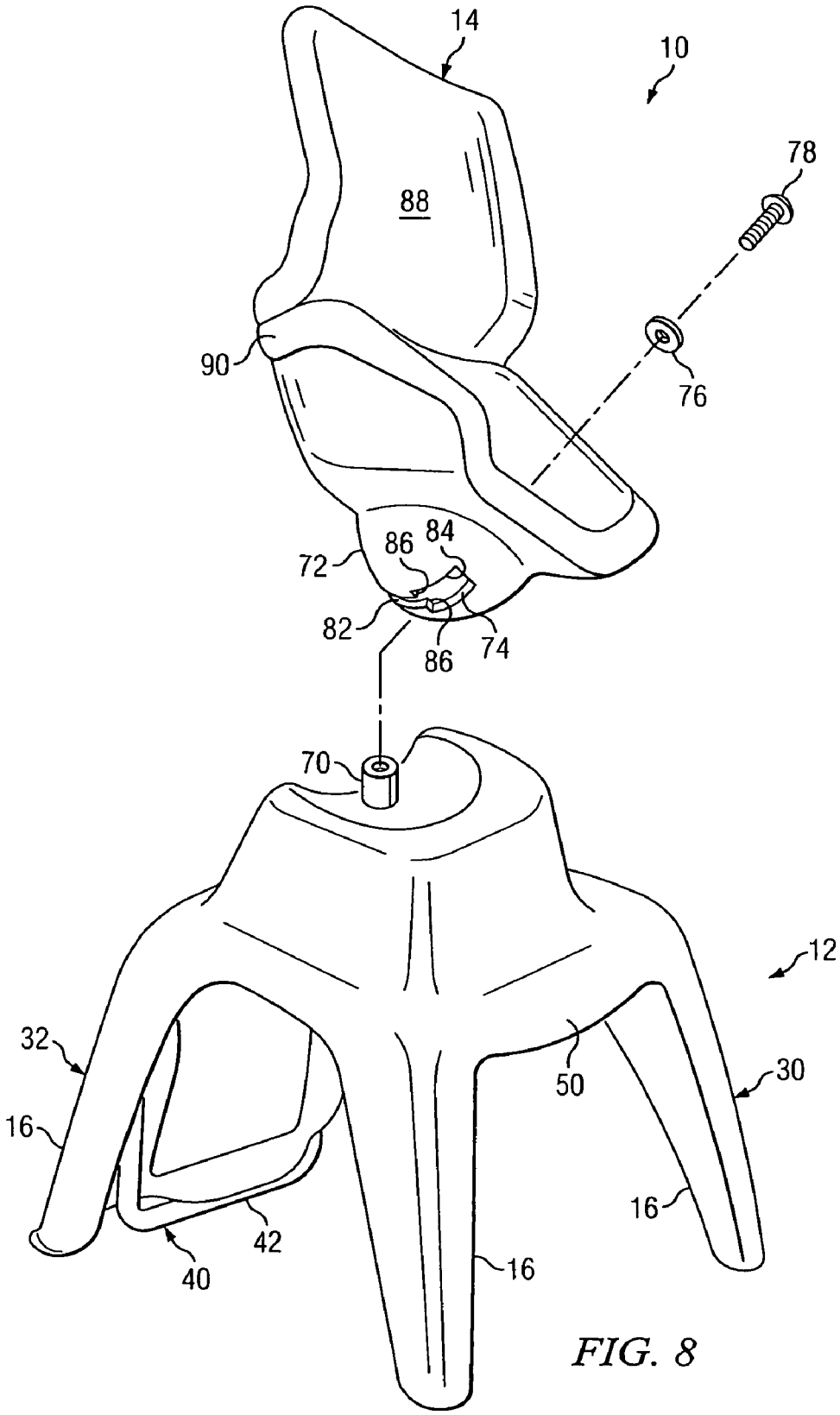
FIG. 8 is an exploded view of the high chair of FIG. 1.
Figure 10:
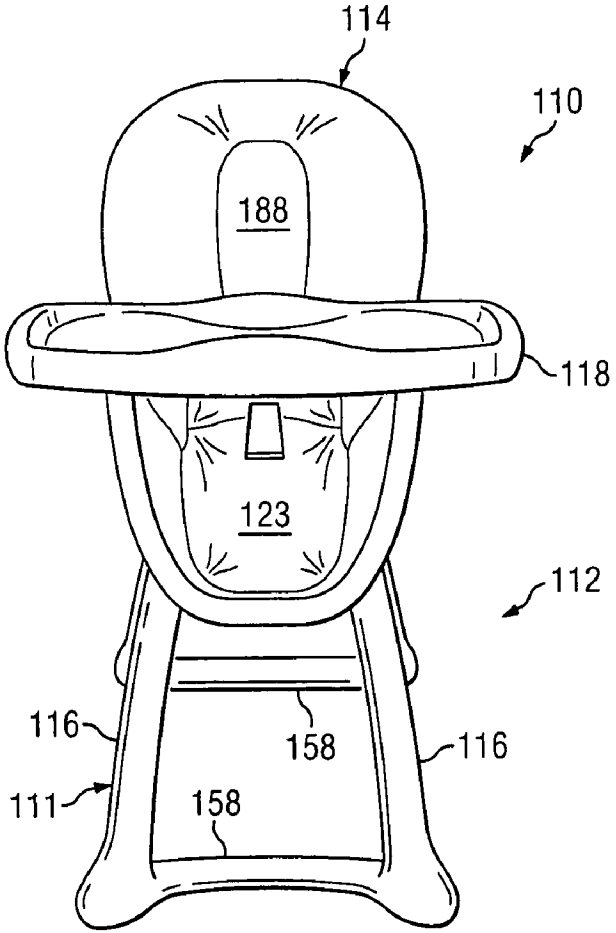
FIG. 10 is a front view of the high chair of FIG. 9.

To provide for rotation of the seat 14 relative to the base 12, the second base portion 32 is provided with a substantially vertically oriented cylindrical post 70 (see FIG. 8). Preferably, the post 70 is integrally formed with the top of the second base portion 32. The area of the base 12 around the post 70 provides a support surface for holding the seat 14 at a desired height.

As shown in FIG. 8, the bottom of the seat 14 preferably includes a semi-spherical projection 72. An opening 74 is centrally formed in the semi-spherical projection 72. The opening 74 is dimensioned to receive the post 70. To secure the seat 14 to the post 70 after the seat 14 is positioned on the base 12 with the post 70 extending through the opening 74, a washer 76 and fastener 78 (e.g., a screw) are secured to the top of the post 70. The washer 76 prevents the seat 14 from being lifted off of the post 70 while permitting free rotation of the seat 14 about the post 70. The semi-spherical projection 72 of the seat 14 ensures that the post 70, the washer 76 and the fastener 78 are disposed below the seating surface and do not contact the child. To this end, a flat, padded seating surface (not shown) is preferably secured on the seat 14 in a conventional manner to thereby seal off the interior of the semi-circularly projection 72 from the child.

To permit tilting of the seat 14 between an upright position and a reclined position (see, for example, FIG. 3), the opening 74 in the bottom of the seat 14 is preferably a slot as shown in FIG. 8. To provide for stability against unwanted tilting of the seat 14, the slot 74 preferably includes scalloped side portions so that the slot 74 defines at least two separate chambers or notches 82, 84. The chambers 82, 84 are in open communication, but are separated by inwardly extending projection(s) forming the scalloped side edges. By forcing the chair 14 forward or backward, such that the projection(s) pass the post 70, the adult user can secure the seat 14 for rotation about the vertical axis 70 in either the reclined or upright position.

While the seat 14 can be constructed in many ways, in the illustrated example it comprises two molded plastic parts, namely, a back rest 88 and a seat bottom 90. Preferably, the back rest 88 and seat bottom 90 are secured to one another via fasteners such as bolts, screws or rivets.

The seat bottom 90 can define a recess in which the child is secured that is trapezoidal in shape; i.e., wider at the top and narrower at the bottom. Such a trapezoidal shape may accommodate children of all sizes, with the smaller children fitting snuggly in the narrower bottom and larger children accommodated by the wider top.

While in the example of FIGS. 1–8, the tray support 24 includes two legs 26, it is presently preferred that one of the legs 26 be eliminated such that the tray 18 is cantilevered to the base 14. In such an approach, the relative movement between the base sections 30, 32 is preferably eliminated. In such an approach, the divider 44 is eliminated or mounted to the seat bottom so rotation of the seat 14 is not inhibited by the divider 44. Although in the example of FIGS. 1–8, the seat 14 is secured in the forward facing position by the presence of the divider 44 and seat bottom notch 68, a separate latch may optionally be provided to secure the seat 14 at various angular positions relative to the base 14. In the example of FIGS. 1–8, no such separate latch is needed because the divider 44 provides this latching function when the seat 14 is fowardly oriented and, when the seat 14 is pivoted to, for example, remove the child from the chair 10, no such latching is needed.

Another example high chair 110 constructed in accordance with the teachings of the invention is shown in FIGS. 9–16. Whenever possible, structures in the example of FIGS. 9–16 that are like structures in the example of FIGS. 1–8 are referred to with the reference numerals from FIGS. 1–8 summed with 100. The high chair 110 as shown in FIGS. 9–12 is illustrated with a seat 114 positioned in a forward-facing orientation. As used herein, this forward-facing orientation is referred to as the zero degree (0°) orientation or the starting seat position.

The example high chair 110 has a base 112 and a seat 114 supported on a top end of the base 112. The illustrated base 112 has a pair of leg assemblies 111 coupled to one another at a common pivot 113 located at their respective top ends. Each leg assembly 111 includes a pair of legs 116 extending downward from the pivot 111 and spaced apart from one another. The lower ends of each pair of legs 116 of each leg assembly 111 are interconnected by a transverse beam 158 for structural rigidity. The respective transverse beams 158 and the bottom ends of the 116 simultaneously rest on a ground or floor surface that supports the high chair 110 to further provide the chair 110 with ample stability during use.

In the present example, the base 112 has a seat support 117 (see FIG. 12) positioned near the upper ends of the leg assemblies 111. A pair of trunnions 119 are carried on opposite sides of the seat support 117. In one example, one of the leg assemblies 111 is a fixed assembly which is affixed to and depends at an angle from vertical downwardly from the trunnions 119 with one leg of the assembly 111 extending from each trunnion 119. The other leg assembly 111 is a pivotable assembly which is pivotally attached to the fixed trunnions 119 with one leg of the pivotable assembly 111 pivotally coupled to each trunnion 119. The pivoting leg assembly can pivot about an axis toward and away from the fixed leg assembly in this example.

Each trunnion 119 of the disclosed example includes an interior or inwardly facing bearing surface (not shown). The upper end of each leg 116 of the pivotable assembly 111 has a cooperating or mating bearing surface that bears against the inwardly facing bearing surface of the respective trunnion 119. The bearing surfaces at each trunnion 119 provide stability for the pivot and also permit the leg assemblies 111 to rotate easily toward and away from one another.

The seat support 117 of the high chair 110 illustrated in FIGS. 9–16 has a top surface on which a turntable assembly 121 rests. The turntable assembly 121 is coupled to the seat support 117 at a pivot or rotation axis. In this example, the pivot is generally centrally located relative to the turntable assembly 121 and seat support 117, although the pivot position can vary considerably and yet provide a chair seat that swivels appropriately as desired. A bottom surface of the turntable assembly 121 faces and slidably bears against the top surface of the seat support 117. The pivot defines a generally vertical axis about which the turntable assembly 121 can rotate relative to, and on top of, the seat support 117. In the example of FIGS. 9–16, the turntable assembly 121 can rotate in any direction through a full 360°, about the seat support pivot. A swivel high chair can also be provided wherein the chair seat can pivot through angles less than 360° if desired.

A high chair seat 114 is carried on a top surface of the turntable assembly 121 in the example of FIGS. 9–16. The high chair seat 114 includes a seat back 188, a seat bottom 190, and a leg rest 123 depending from a forward edge of the seat bottom 190. A tray 118 is removably coupled to, and optionally rotated with, the high chair seat 114. As is known to those of ordinary skill in the art, the tray can be adjusted fore and aft relative to the seat back 188 and can also be completely removed from the high chair seat 114 when desired via a conventional latching system.

Figure 14:
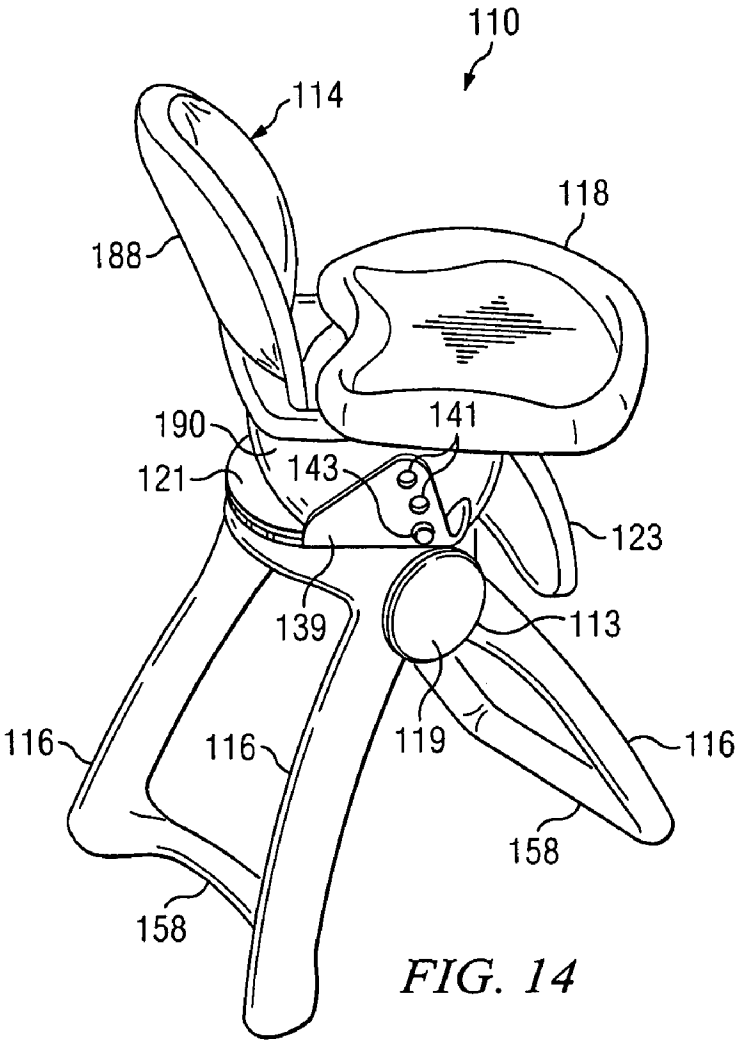
FIG. 14 is a perspective view of the high chair of FIG. 9 with the seat rotated counterclockwise to a position about 135° from the forward-facing orientation.
Figure 13:
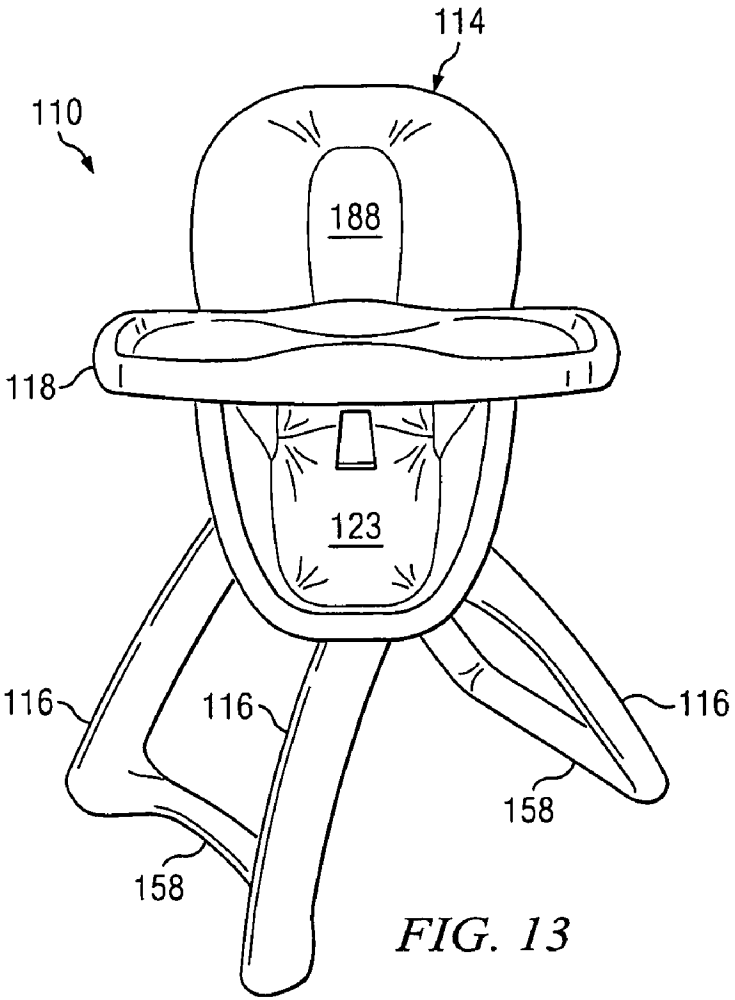
FIG. 13 is a perspective view of the high chair of FIG. 9 with the seat rotated counterclockwise to a position about 45° from the forward-facing orientation.
Figure 16:
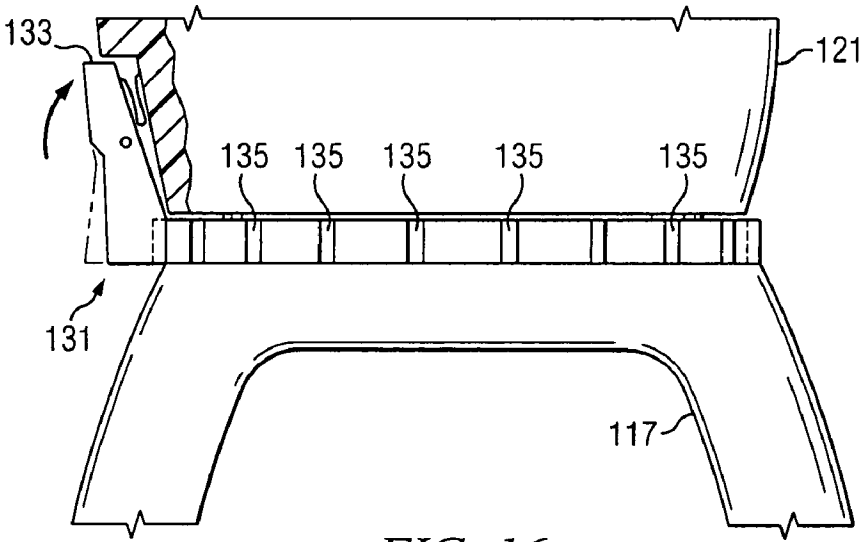
FIG. 16 is a schematic view of the latching lever and turntable of the high chair of FIG. 9.
Figure 15:
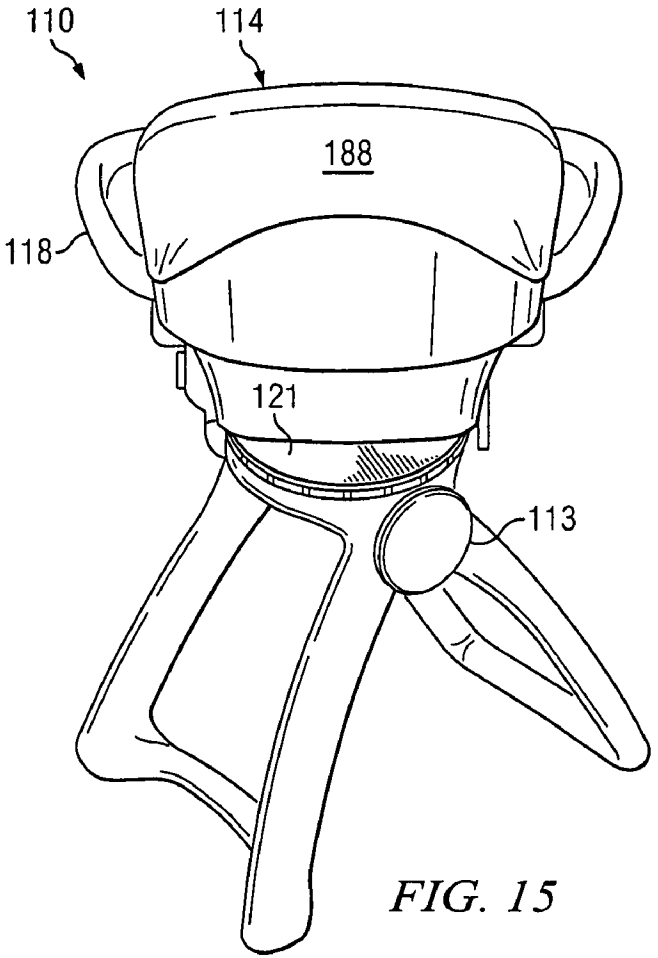
FIG. 15 is a perspective view of the high chair of FIG. 9 with the seat rotated counterclockwise to a position about 225° from the forward-facing orientation.

When mounted on the turntable assembly 121, the high chair seat 114 can swivel on the seat support 117 about the pivot or rotation axis and relative to the base 112 in accordance with movement of the turntable assembly 121. As shown in FIG. 13, the high chair seat 114 can be pivoted to a position that is 45° from the forward-facing position shown in FIG. 9. As shown in FIG. 14, the high chair seat 114 can be rotated to a position that is 135° relative to the forward-facing orientation of FIG. 9. As shown in FIG. 15, the high chair seat 114 can be rotated to a position that is 225° relative to the forward-facing position. In each of FIGS. 13–15, the high chair seat 114 is rotated in a counterclockwise direction with reference to the 0° position. As will be evident to those having ordinary skill in the art, the high chair seat 114 can also be rotated to alternative orientations other than those shown in FIGS. 9 and 13–15. By way of examples, not limitations, the high chair seat 114 can be rotated and positioned 90° from the forward-facing position, 180° from the forward-facing position, and/or 270° from the forward-facing position. Then, the high chair seat 114 can be oriented in positions other than those shown and described herein.

Figure 9:
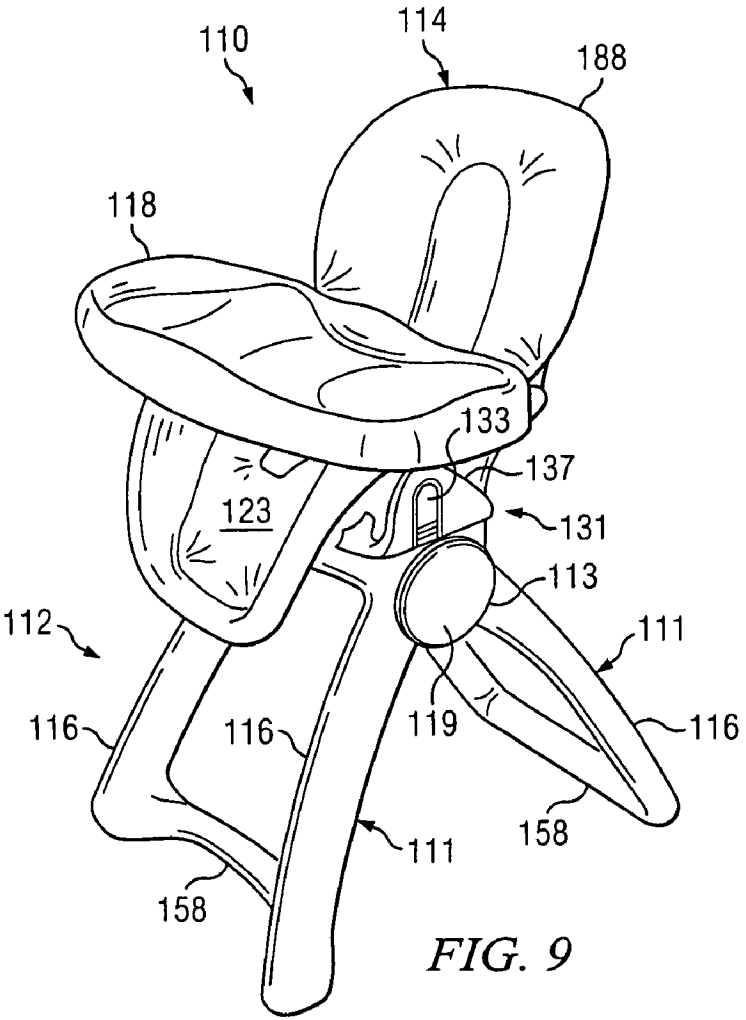
FIG. 9 is a perspective view of another example high chair constructed in accordance with the teachings of the invention and shown with the seat in a forward-facing orientation.
Figure 12:
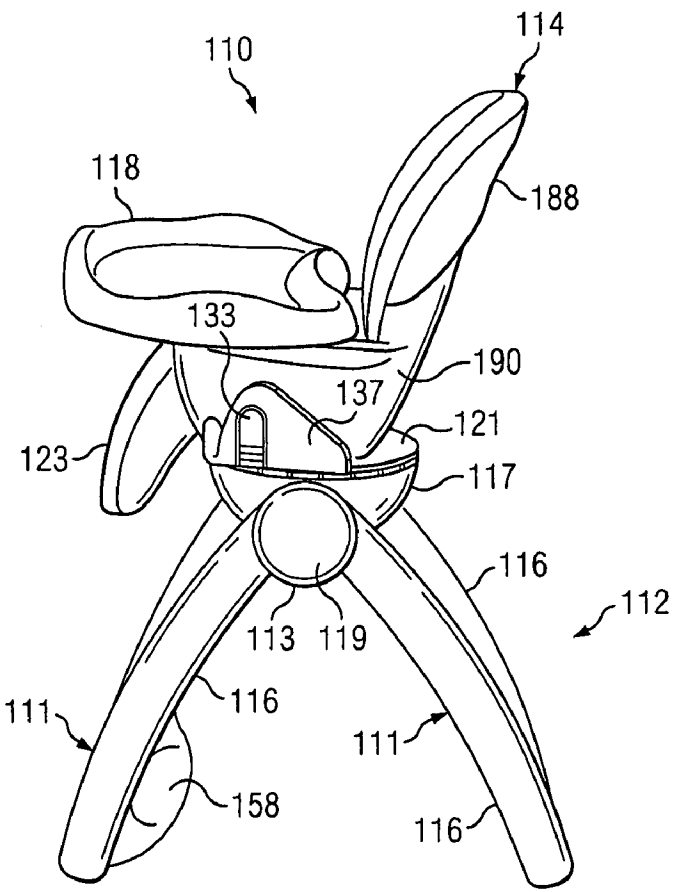
FIG. 12 is a side view of the high chair of FIG. 9.
Figure 11:
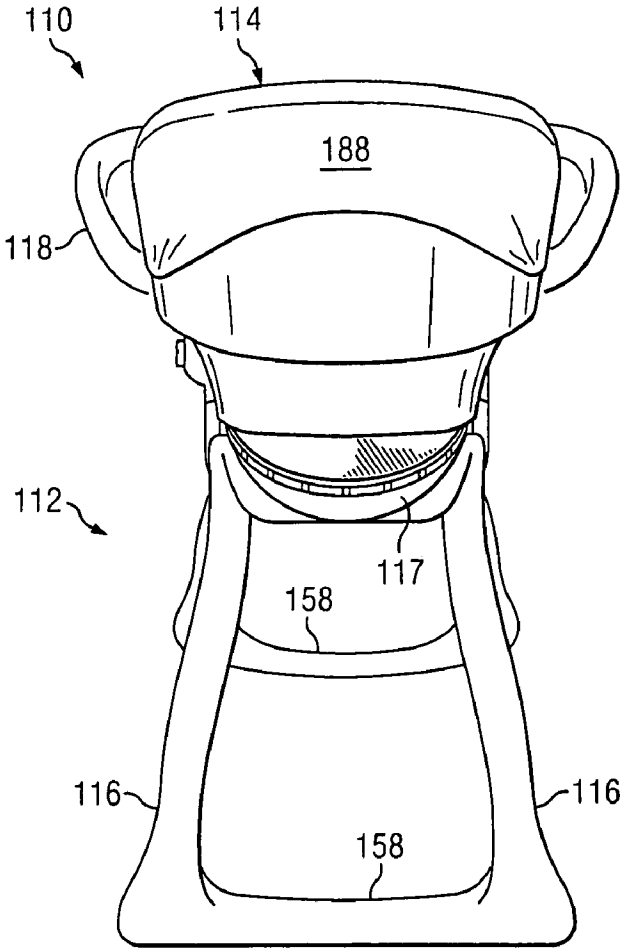
FIG. 11 is a rear view of the high chair of FIG. 9.

As shown in FIG. 9, the high chair 110 of FIGS. 9–16 includes a lock and release mechanism 131 for locking the turntable assembly 121 in a particular selected orientation relative to the forward-facing position and for releasing the turntable assembly 121 so that the rotational orientation of the high chair seat 114 can be adjusted. In the illustrated example, the lock and release mechanism 131 includes a release button 133 that, when depressed, releases the high chair seat 114 and turntable assembly 121 from its present orientation. The lock mechanism is structured so that the turntable assembly 121 once moved from its present location, can be rotated to a next available orientation, even when the release button 133 is no longer depressed. To this end, the lock and release mechanism in cooperation with the seat support 117 and the turntable assembly 121 includes a detent device providing a finite number of selectable high chair seat positions relative to the forward-facing orientation. In the example of FIGS. 9–16, the circumferential edge of the turntable 117 includes a plurality of notches 135 for receiving a spring biased latch 133 of the mechanism.

In another example, the lock and release mechanism is a lever that is pulled in order to release the high chair seat 114 and turntable assembly 121 from its current position, and to permit the high chair seat 114 and turntable assembly 121 to be rotated to alternative positions. As will be evident to those of ordinary skill in the art, various lock and release type mechanisms can also be utilized within the scope of the present invention. For the illustrated high chair, it is desirable that the high chair seat 114 automatically lock into a next nearest selectable detent position after being released from a current position utilizing the lock and release mechanism.

The swivel high chair of FIGS. 9–16 can also include a height adjustable feature. To this end, the leg assemblies 111 or some other portion of the base 112 can be provided with height adjustable segments so that the high chair seat position can be selectively varied relative to a ground surface on which the high chair 110 rests.

The swivel high chair of FIGS. 9–16 also includes a seat reclining feature. To this end, the turntable assembly 121 has a pair of opposed upstanding plates 137, 139. One plate 137

(see FIG. 9) carries the release button 133 and is associated with the lock and release mechanism. The other plate 139 (see FIG. 14) has a plurality of openings 141 for receiving a seat recline pin 143. The pin 143 can be received through one of the openings 141 to select a desired seat recline angle.

In using one of the high chairs illustrated herein to feed a child, one would first safely secure the child in the seat via a seat belt or the like. One would then rotate the high chair from a first position (e.g., the position of the seat when the child is placed therein) to a second position (e.g., a position facing a conventional chair the adult wishes to use in feeding the child or a tray so that the child may be fed from the tray). The adult would then feed the child in the normal manner. After the child is fed, the high chair may be rotated from the second position to the first position, for example, and the child removed. In the example of FIGS. 1–8, the rotation from the second position (e.g. facing the tray) to the first position (e.g. parallel to the tray) may permit the child to be removed prior to the post meal clean up of the tray while limiting the disturbance of the tray.

Optionally, the chair is releasably secured in the second position. If desired, the chair could be further rotated to a third position which is different than the first and second positions (e.g., to permit a second adult to continue feeding the child or to permit removal of the child prior to post meal clean up). As a further option, the seat could be reclined backward or positioned upright to best suit the needs of the child and adult. In fact, depending on the age and abilities of the child, it may be desirable, using the example of FIGS. 1–8, to recline the seat without rotating the seat. That is, if the child is placed in the high chair of FIGS. 1–8 with the seat oriented as in FIG. 4 and the seat is reclined, the distance between food on the tray and the child's mouth does not significantly increase.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A high chair for feeding a child comprising:

a base;

a chair sized to support a child, the chair being supported on the base at a height suitable for feeding a child, the chair being rotatable relative to the base about a substantially vertical axis; and a tray mounted to the base such that the chair is rotatable relative to the tray, wherein the base includes a vertically extending post and the chair defines an opening to receive the post such that the post defines the vertical axis, wherein the opening is a slot dimensioned to permit rotation of the chair about the post and tilting of the chair relative to the post, and further comprising a first notch, a second notch, and a projection separating the first and second notches, wherein when the post is located in the first notch, the chair is secured in an upright position and when the post is located in the second notch, the chair is secured in a reclined position.

2. A high chair as defined in claim 1 wherein the tray is cantilevered to the base.

3. A high chair as defined in claim 1 wherein the base includes a first section supporting the tray and a second section supporting the chair, and a first one of the first and second sections can be moved relative to a second one of the first and second sections to separate the seat and the tray.

4. A high chair as defined in claim 3 wherein the seat is only rotatable relative to the tray when the first section is displaced a distance from the second section of the base.

5. A high chair as defined in claim 3 wherein the second section of the base includes rollers to facilitate movement of the second section of the base from the first section of the base.

6. A high chair as defined in claim 1 further comprising a tray support coupling the tray to the base.

7. A high chair as defined in claim 6 wherein the tray is removably coupled to the tray support.

8. A high chair as defined in claim 1 further comprising a substantially vertical bar disposed below the tray and located to be positioned between legs of a child seated in the high chair.

9. A high chair as defined in claim 1 further comprising a latch for selectively securing the chair against rotation about the vertical axis.

10. A high chair as defined in claim 1 wherein the chair is mounted to the base such that it can be reclined.

11. A high chair as defined in claim 1 wherein the base includes a first section and a second section, and a first one of the first and second sections can be separated from a second one of the first and second sections to position the seat for rotation.

12. A high chair as defined in claim 11 wherein at least one of the first and second sections of the base includes rollers to facilitate separation of the first and second sections of the base.

13. A high chair as defined in claim 1 wherein the chair defines a post receiving area located beneath a seating surface of the chair, and the seat is secured to the post beneath the seating surface.

14. A high chair as defined in claim 13 wherein the chair has an upright position and a reclined position.

15. A high chair as defined in claim 14 wherein the chair can be rotated when it is in the reclined position and when it is in the upright position.

16. A high chair as defined in claim 1 further comprising a turntable rotatably securing the chair to the base.

17. A high chair as defined in claim 16 further comprising a latch for selectively securing the chair and turntable against rotation relative to the base.

18. A high chair as defined in claim 1 wherein the base includes a first support and a second support, and a first one of the first and second supports is pivotable relative to a second one of the first and second supports to collapse the base.

19. A method of feeding a child in a high chair as defined in claim 1, the method comprising:

securing the child in the high chair with the seat in a first position facing away from a tray;

rotating the high chair from the first position to a second position wherein the seat faces toward the tray; and feeding the child.

20. A method as defined in claim 19 further comprising:

securing the chair in the second position.

21. A method as defined in claim 19 further comprising:

rotating the high chair from the second position to a third position.

22. A method as defined in claim 19 further comprising:

reclining the chair.

23. A method as defined in claim 19 further comprising:

rotating the high chair from the second position to the first position; and removing the child from the high chair.

* * * * *